US011761188B2

(12) United States Patent
Kobayashi et al.

(10) Patent No.: US 11,761,188 B2
(45) Date of Patent: Sep. 19, 2023

(54) TOILET DEVICE

(71) Applicant: TOTO LTD., Kitakyushu (JP)

(72) Inventors: Motoki Kobayashi, Kitakyushu (JP); Yuya Masahira, Kitakyushu (JP); Yuichi Kawasaki, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 99 days.

(21) Appl. No.: 17/464,950

(22) Filed: Sep. 2, 2021

(65) Prior Publication Data

US 2022/0120070 A1 Apr. 21, 2022

(30) Foreign Application Priority Data

Oct. 21, 2020 (JP) ..... 2020-176827

(51) Int. Cl.
*E03D 5/10* (2006.01)
*E03D 11/08* (2006.01)

(52) U.S. Cl.
CPC ..... *E03D 5/10* (2013.01); *E03D 11/08* (2013.01)

(58) Field of Classification Search
CPC ..... E03D 11/13
See application file for complete search history.

(56) References Cited

U.S. PATENT DOCUMENTS

2018/0371734 A1* 12/2018 Salemi Parizi ..... G01F 23/268
2020/0123752 A1* 4/2020 Tsuiki ..... E03D 11/00
2020/0392710 A1* 12/2020 Saruta ..... G06Q 10/063

FOREIGN PATENT DOCUMENTS

JP 2020-066889 A 4/2020

* cited by examiner

*Primary Examiner* — Christine J Skubinna
(74) *Attorney, Agent, or Firm* — PEARNE & GORDON LLP

(57) ABSTRACT

According to the embodiment, a toilet device includes a toilet, a flow channel, a wash water supply unit a sensing unit and a controller. The sensing unit is configured to sense whether or not the wash water is at a position lower than a full water level and higher than a sealing water level on a surface of a bowl of the toilet. The controller is configured to determine a clogging state of the toilet based on a sensing result of the sensing unit following the closing of the wash water supply unit. A sensing region of the sensing unit is a position on the surface of the bowl through which the wash water flowing in a vertical direction from a water discharge port of the flow channel to a bottom portion of the bowl passes after the wash water supply unit is closed.

6 Claims, 9 Drawing Sheets

TOILET DEVICE

CROSS-REFERENCE TO RELATED APPLICATIONS

This application is based upon and claims the benefit of priority from Japanese Patent Application No. 2020-176827, filed on Oct. 21, 2020; the entire contents of which are incorporated herein by reference.

FIELD

Embodiments described herein relate generally to a toilet device.

BACKGROUND

Known is a toilet device including a sensing unit sensing whether or not water is on the surface of a toilet bowl and a controller determining toilet clogging based on the sensing result of the sensing unit (JP-A-2020-66889).

In a case where the surface of the toilet bowl is dirty, for example, the sensing unit may sense the dirt and erroneously determine that the toilet is clogged. In such a case, the toilet cannot be used and a decline in toilet usability arises.

SUMMARY

According to the embodiment, a toilet device includes a toilet, a flow channel, a wash water supply unit a sensing unit and a controller. The toilet has a bowl. The flow channel has a water discharge port configured to discharge wash water to the bowl. The wash water supply unit provides on the flow channel and configured to open or close to control a flow of the wash water. The sensing unit is configured to sense whether or not the wash water is at a position lower than a full water level and higher than a sealing water level on a surface of the bowl. The controller is configured to determine a clogging state of the toilet based on a sensing result of the sensing unit following the closing of the wash water supply unit. A sensing region of the sensing unit is a position on the surface of the bowl through which the wash water flowing in a vertical direction from the water discharge port of to a bottom portion of the bowl passes after the wash water supply unit is closed.

DETAILED DESCRIPTION

Figure 1:
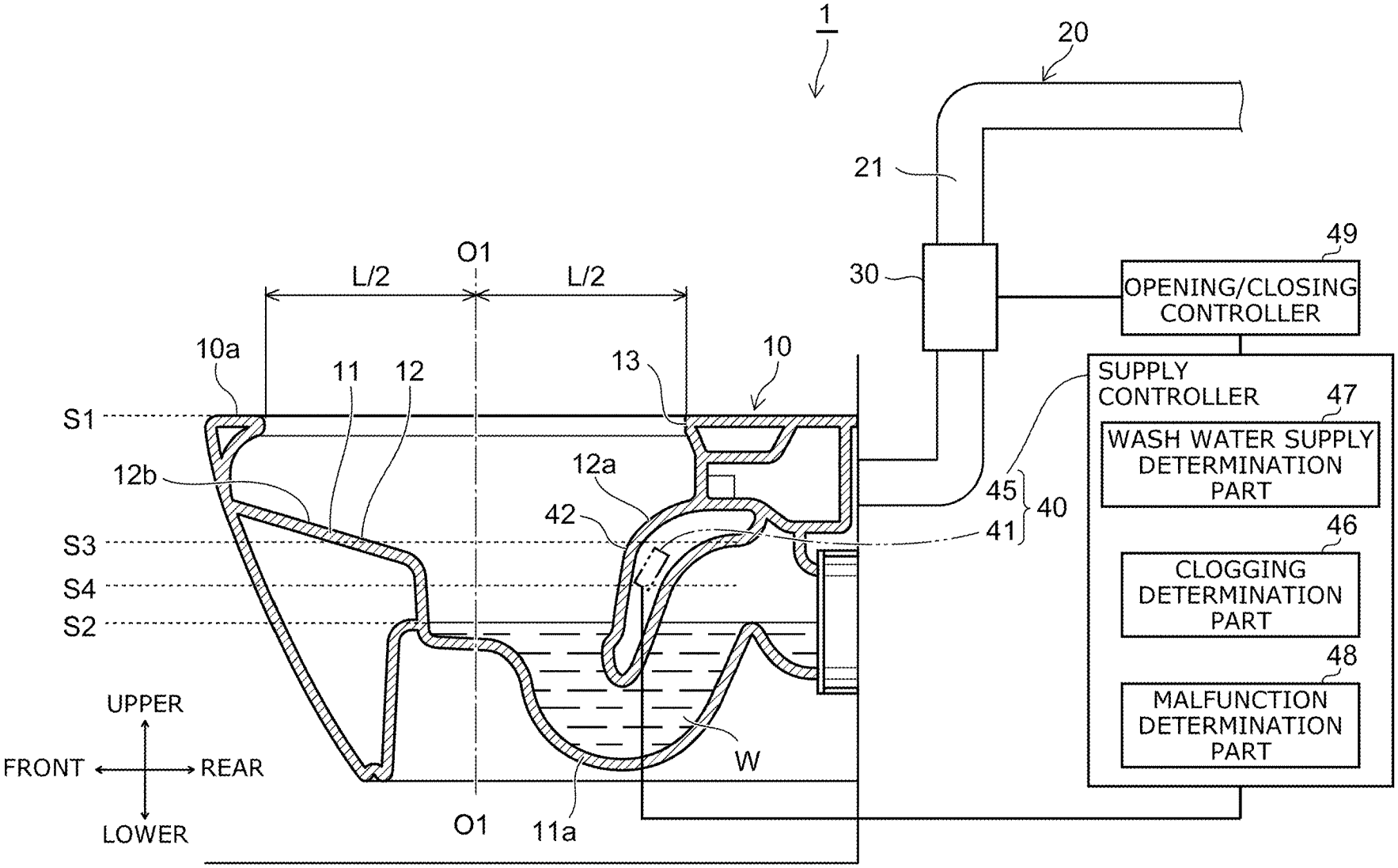
FIG. 1 is a schematic view showing the configuration of a toilet system having the toilet device according to the embodiment of the invention.

A toilet device according to an aspect of the invention includes: a toilet having a bowl; a flow channel having a water discharge port configured to discharge wash water to the bowl; a wash water supply unit provided on the flow channel and configured to open or close to control a flow of the wash water; a sensing unit configured to sense whether or not the wash water is at a position lower than a full water level and higher than a sealing water level on a surface of the bowl; and a controller configured to determine a clogging state of the toilet based on a sensing result of the sensing unit following the closing of the wash water supply unit, in which a sensing region of the sensing unit is a position on the surface of the bowl through which the wash water flowing in a vertical direction from the water discharge port to a bottom portion of the bowl passes after the wash water supply unit is closed.

Hereinafter, an embodiment of the invention will be described with reference to the drawings. It should be noted that similar components are denoted by the same reference numerals in the drawings with detailed description thereof omitted as appropriate.

FIG. 1 is a schematic view showing the configuration of a toilet system having the toilet device according to the embodiment of the invention.

As shown in FIG. 1, a toilet system 1 according to the embodiment includes a toilet 10 having a bowl 11, a wash water supply unit 30 supplying wash water W to the bowl 11, and a toilet device 40. In the specification of the application, "upper", "lower", "front", "rear", "left side", and "right side" are directions seen from a user seated on the toilet seat of the toilet 10.

Figure 2B:
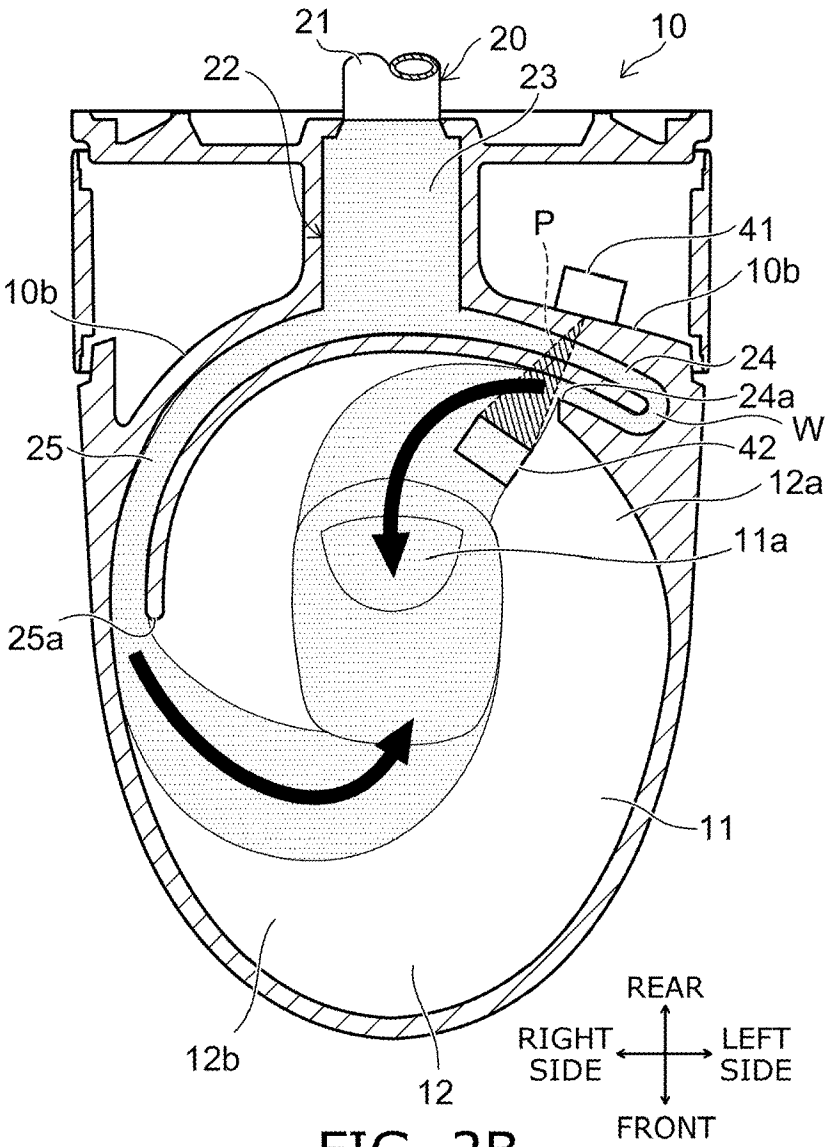
FIGS. 2A and 2B are cross-sectional views schematically showing a state of the wash water flowing on the surface of the bowl.
Figure 2A:
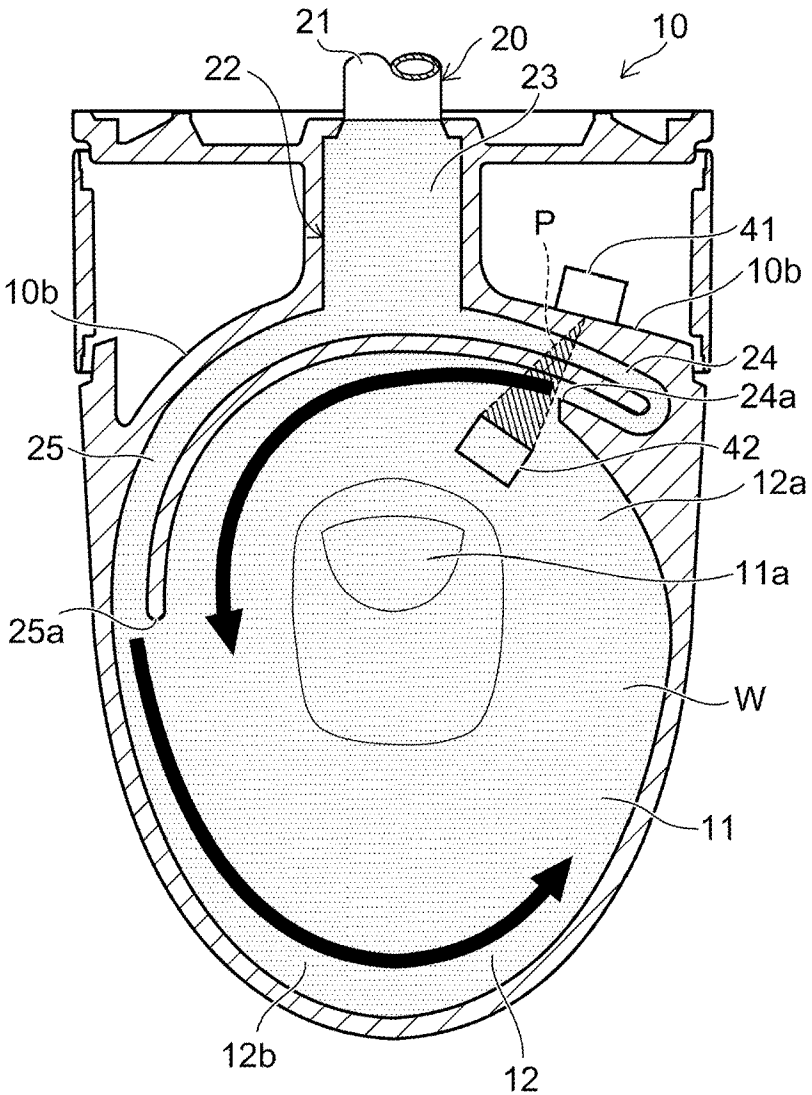

FIGS. 2A and 2B are cross-sectional views schematically showing a state of the wash water flowing on the surface of the bowl.

Figure 3B:
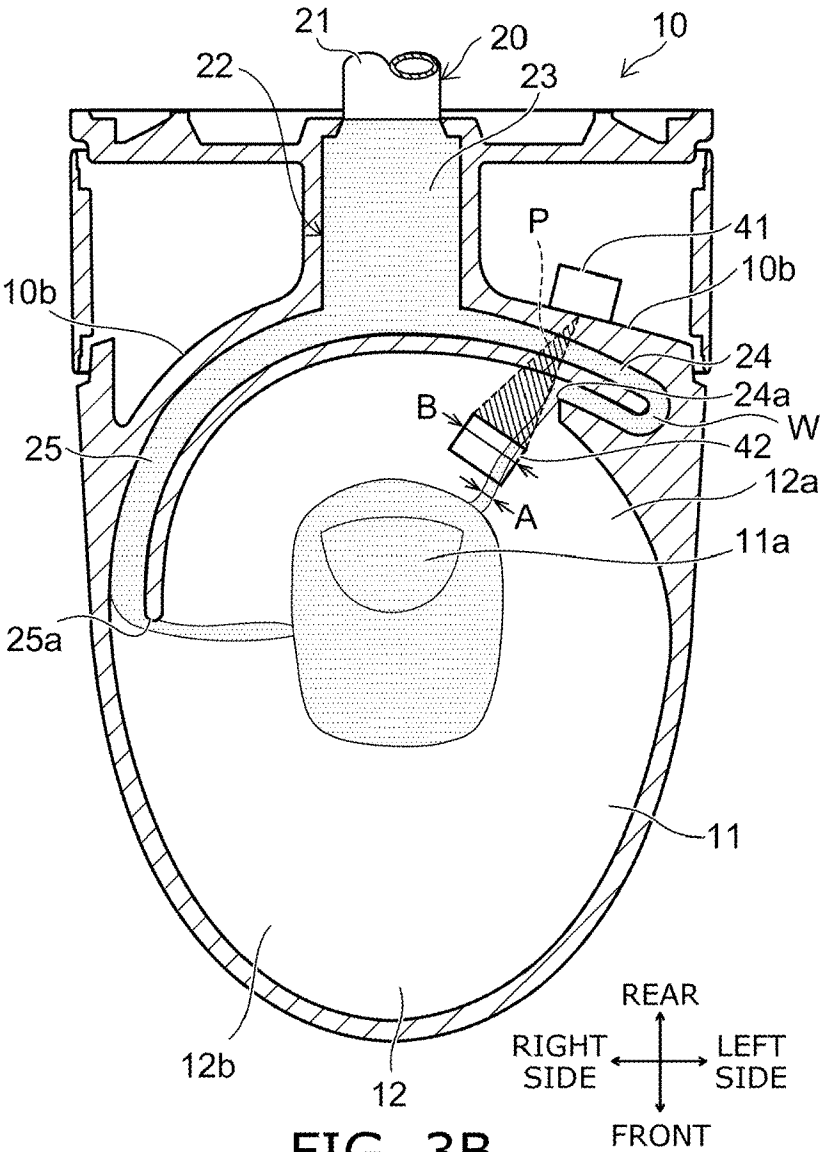
FIGS. 3A and 3B are cross-sectional views schematically showing a state of the wash water flowing on the surface of the bowl.
Figure 3A:
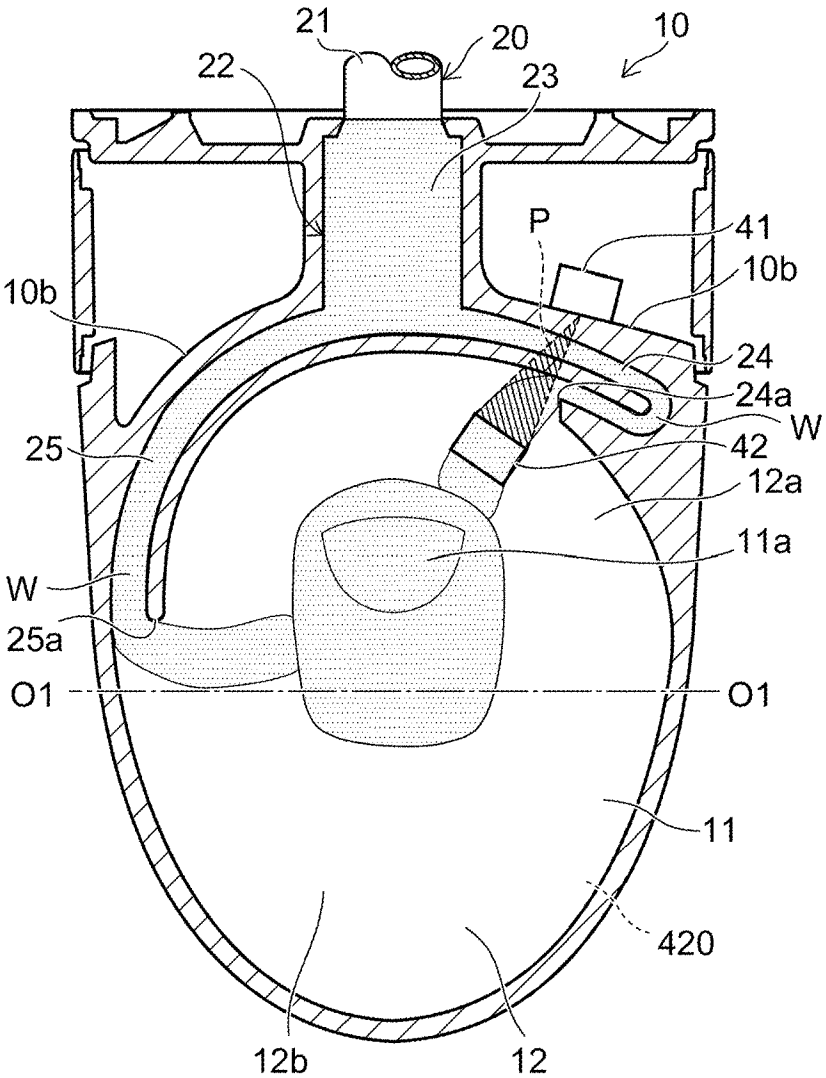

FIGS. 3A and 3B are cross-sectional views schematically showing a state of the wash water flowing on the surface of the bowl.

FIG. 2A is a schematic cross-sectional view in which the surface of the bowl is in the process of washing.

FIG. 2B is a schematic cross-sectional view in which the wash water supply unit has just been closed.

FIG. 3A is a cross-sectional view schematically showing a state where more time has passed since the closing of the wash water supply unit.

FIG. 3B is a cross-sectional view schematically showing a state immediately preceding the completion of washing or a case where the wash water supply unit malfunctions.

Figure 4:
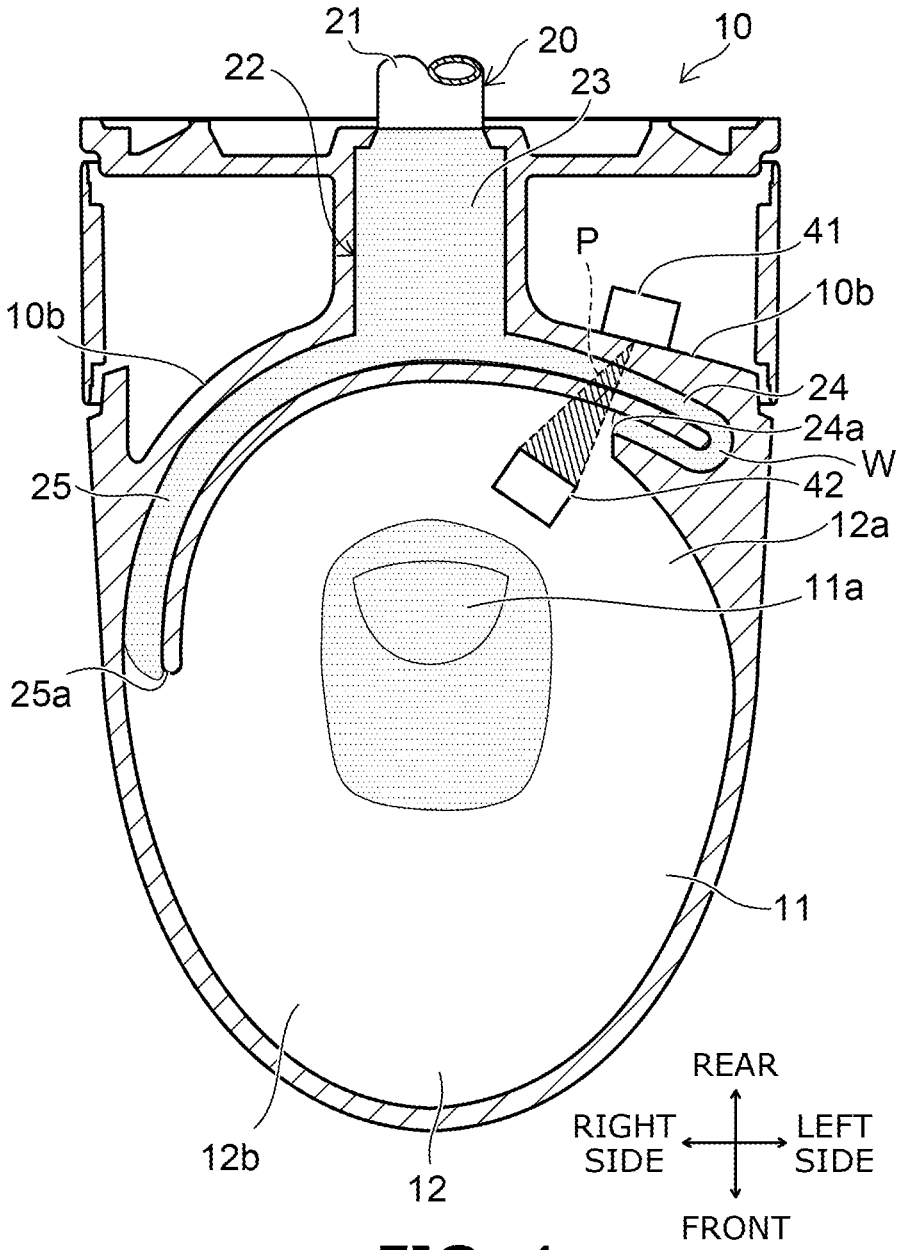
FIG. 4 is a cross-sectional view schematically showing a case where the wash water supply unit malfunctions.

FIG. 4 is a cross-sectional view schematically showing a case where the wash water supply unit malfunctions.

Figure 5:
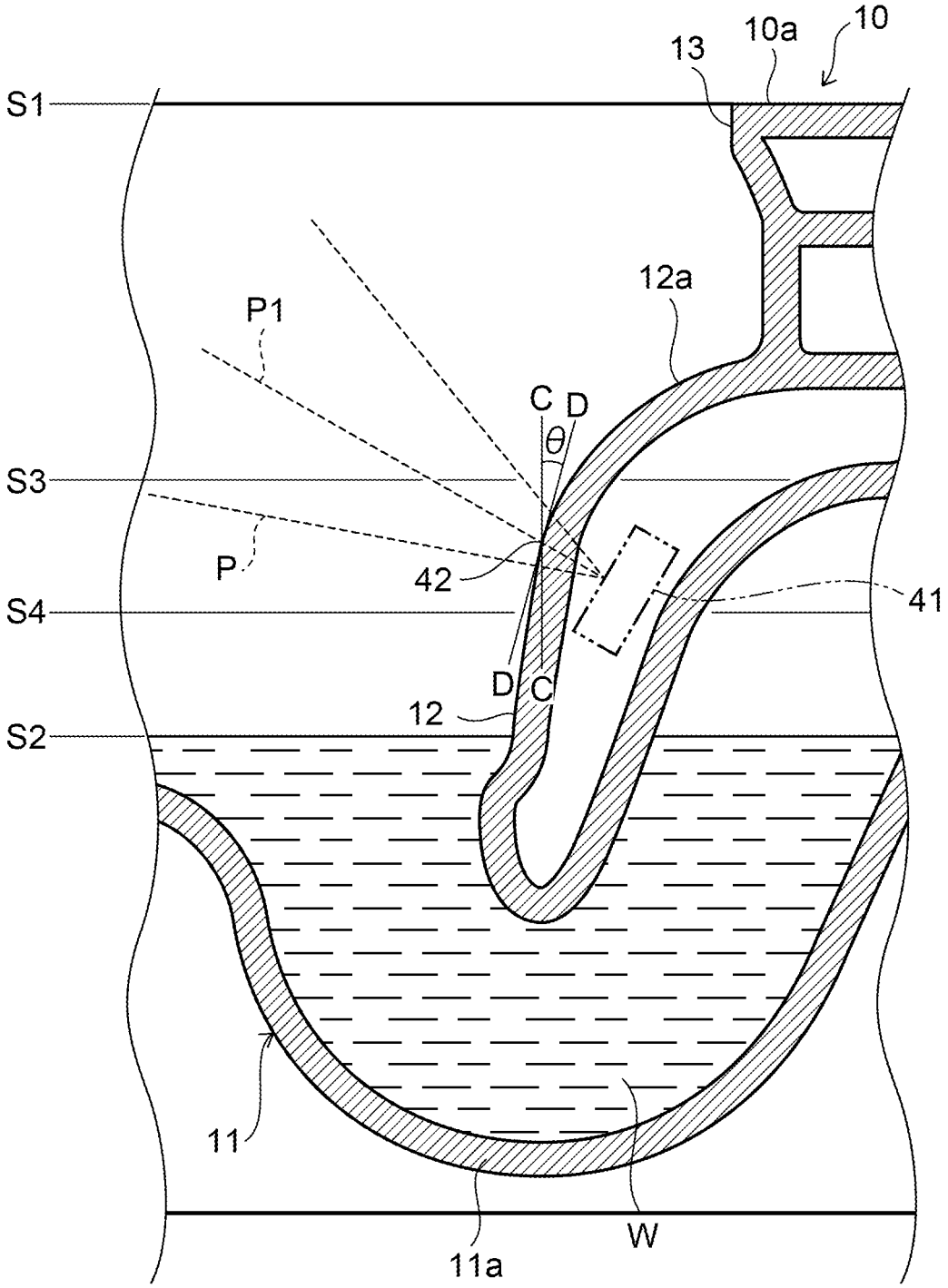
FIG. 5 is an enlarged cross-sectional view schematically showing the position of the sensing region of a sensing unit on the surface of the bowl.

FIG. 5 is an enlarged cross-sectional view schematically showing the position of the sensing region of a sensing unit on the surface of the bowl.

The toilet 10 is a so-called sit-down toilet. The toilet seat (not shown) is arranged on an upper surface 10*a* of the toilet 10. The toilet 10 has the recessed bowl 11 recessed downward from the upper surface 10*a*. In other words, the inner end portion of the upper surface 10*a* of the toilet 10 is an opening 13 of the bowl 11. The toilet 10 receives excrement such as the user's urine and feces in the bowl 11. In the toilet 10, the wash water W is supplied from a flow channel 20 when the user washes the toilet or stands up from the toilet seat. The toilet 10 is washed with the wash water W, during which the excrement in the bowl 11 is discharged and a surface 12 of the bowl 11 is washed. After the toilet is washed, the wash water W (sealing water) collects in a bottom portion 11*a* of the bowl 11. The surface 12 of the bowl 11 is formed such that a rear side 12*a* is more vertical than a front side 12*b*.

The flow channel 20 interconnects a water supply source (not shown) and the bowl 11. The wash water W supplied to the bowl 11 flows through the flow channel 20. The flow channel 20 has a water supply pipe line 21 extending from the water supply source to the toilet 10 and a wash water passageway 22 provided inside the toilet 10 and extending from the water supply pipe line 21 to the bowl 11.

The wash water passageway 22 bifurcates inside the toilet 10. Specifically, the wash water passageway 22 has a main passageway 23 connected to the water supply pipe line 21, a first branch passageway 24 extending clockwise (to the left) from the main passageway 23 and communicating with the surface 12 of the bowl 11, and a second branch passageway 25 extending counterclockwise (to the right) from the main passageway 23 and communicating with the surface 12 of the bowl 11 at a position different from that of the first branch passageway 24. The first branch passageway 24 and the second branch passageway 25 are rim conduits formed on the opening 13 side (upper surface 10*a* side) of the bowl 11.

The first branch passageway 24 has a first water discharge port 24*a* opening to the surface 12 of the bowl 11. The second branch passageway 25 has a second water discharge port 25*a* opening to the surface 12 of the bowl 11. The first water discharge port 24*a* and the second water discharge port 25*a* communicate with the surface 12 of the bowl 11 at different positions.

The first water discharge port 24*a* discharges the wash water W from the left rear side of the bowl 11 along the surface 12 of the bowl 11. The second water discharge port 25*a* is disposed apart from the first water discharge port 24*a* in the circumferential direction. The second water discharge port 25*a* discharges the wash water W from the right side of the bowl 11 along the surface 12 of the bowl 11.

The first water discharge port 24*a* and the second water discharge port 25*a* discharge the wash water W so as to flow counterclockwise to the surface 12 of the bowl 11. In other words, the toilet 10 is provided with two water discharge ports (first water discharge port 24*a* and second water discharge port 25*a*) discharging the wash water W to the bowl 11. It should be noted that the first water discharge port 24*a* and the second water discharge port 25*a* may be provided at other positions apart from each other in the circumferential direction of the bowl 11.

The wash water supply unit 30 is provided on the flow channel 20 discharging the wash water W to the bowl 11. Specifically, the wash water supply unit 30 is provided on the water supply pipe line 21 of the flow channel 20. The wash water supply unit 30 has an on-off valve opened and closed by, for example, a solenoid or a motor. The wash water supply unit 30 is connected to a water supply source such as a water supply and a water storage tank. The wash water supply unit 30 has, for example, a flush valve. The wash water supply unit 30 is connected to an opening/closing controller 49. The opening and closing of the wash water supply unit 30 is controlled by a command signal from the opening/closing controller 49. In addition, the wash water supply unit 30 may appropriately have a water storage tank, a water pumping pump, or the like.

When the user performs the washing operation for washing the toilet 10 using a remote controller (not shown) or the like, the opening/closing controller 49 transmits a signal corresponding to the washing operation to the wash water supply unit 30. The wash water supply unit 30 switches from the closed state to the open state based on the command signal (open signal) transmitted from the opening/closing controller 49. As a result, the wash water W is supplied from the water supply source to the toilet 10 via the flow channel 20.

The toilet device 40 includes a sensing unit 41 provided in the toilet 10 and a supply controller 45 connected to the sensing unit 41. The sensing unit 41 is attached to, for example, the outer surface or the inside of the toilet 10 facing the surface 12 of the bowl 11. As an example, the sensing unit 41 is attached to a storage space 10*b* of the toilet 10 laterally sandwiching the main passageway 23 of the flow channel 20.

The sensing unit 41 senses whether or not the wash water W is in the bowl 11. Specifically, the sensing unit 41 senses whether or not the wash water W is at a position lower than a full water level S1 and higher than a sealing water level S2 on the surface 12 of the bowl 11 of the toilet 10. The full water level S1 is the position where the wash water W overflows from the inside of the bowl 11 and is the position of the upper surface 10*a* of the toilet 10. The sealing water level S2 is the position of the wash water W (sealing water) collecting in the bottom portion 11*a* of the bowl 11 after the toilet 10 is washed.

The sensing unit 41 outputs (transmits) different sensing results to the supply controller 45 depending on the amount or flow velocity of the wash water W flowing on the surface 12 of the bowl 11. The supply controller 45 determines the clogging state of the toilet 10 based on the sensing signal output from the sensing unit 41. The supply controller 45 determines malfunction of the wash water supply unit 30 based on the sensing signal output from the sensing unit 41. A radio wave sensor (microwave sensor), a capacitance sensor, or the like is used as the sensing unit 41.

The radio wave sensor emits radio waves and senses the reflected waves. The intensity of the reflected wave changes depending on the presence or absence of water at the radio wave emission position. In a case where the radio wave sensor is used as the sensing unit 41, the sensing unit 41 is provided such that the radio wave is emitted to a predetermined region on the surface 12 of the bowl 11.

The capacitance sensor senses the capacitance between the sensor and a predetermined region facing the sensor. The capacitance varies with the volume of water in the predetermined region. In a case where the capacitance sensor is used as the sensing unit 41, the sensing unit 41 is provided so as to face the sensing region on the surface 12 of the bowl 11.

The toilet device 40 is capable of sensing whether or not the water level in the bowl 11 is higher than a predetermined region by using the radio wave sensor or the capacitance sensor as the sensing unit 41. The water level can be directly sensed when a plurality of the capacitance sensors are continuously disposed at different heights.

Exemplified in the embodiment is a case where the radio wave sensor as the sensing unit 41 is provided inside the toilet 10 (in the storage space 10*b*). The sensing unit 41 emits a radio wave P to sense whether or not the wash water W is at a position lower than the full water level S1 and higher than the sealing water level S2 on the surface 12 of the bowl 11. In other words, the sensing unit 41 senses a state where the wash water W has collected at a position higher than the sealing water level S2 due to the clogging of the toilet 10. A sensing region 42 of the sensing unit 41 and a sensing method will be described later.

The supply controller 45 is provided in, for example, the toilet 10. It should be noted that the supply controller 45 may be provided in a casing (not shown) placed on the upper surface 10*a* of the toilet 10 or may be provided outside the toilet 10 (in a toilet room or the like). The supply controller 45 constitutes the controller of the invention. The supply controller 45 determines the clogging state of the toilet 10 and malfunction of the wash water supply unit 30 based on the time-dependent change in the sensing result outputted from the sensing unit 41.

The supply controller 45 is connected to the sensing unit 41 and the opening/closing controller 49. The supply controller 45 is connected to, for example, a notification device (not shown) for providing a notification on the clogging state of the toilet 10 or malfunction of the wash water supply unit 30.

The supply controller 45 has a clogging determination part 46 determining whether or not the toilet 10 is clogged based on the sensing result of the sensing unit 41. The supply controller 45 has a wash water supply determination part 47 determining whether or not the wash water W can be supplied to the bowl 11 of the toilet 10 based on the determination result of the clogging determination part 46. The supply controller 45 has a malfunction determination part 48 determining whether or not the wash water supply unit 30 malfunctions based on the sensing result of the sensing unit 41.

The supply controller 45 transmits the determination result of the wash water supply determination part 47 to the opening/closing controller 49 controlling the opening/closing operation of the wash water supply unit 30. It should be noted that the opening/closing controller 49 may be integrated with the supply controller 45. The clogging determination part 46, the wash water supply determination part 47, the malfunction determination part 48, and the opening/closing controller 49 may be separate controllers.

The clogging determination part 46 of the supply controller 45 determines that the toilet 10 is clogged in a case where the sensing unit 41 senses the wash water W a predetermined time after the wash water supply unit 30 is closed. The clogging determination part 46 determines whether or not the toilet 10 is clogged using, for example, the voltage value following the closing of the wash water supply unit 30 by a margin of a predetermined time. The clogging determination regarding the toilet 10 made by the clogging determination part 46 will be described later.

In a case where the clogging determination part 46 determines that the toilet 10 is clogged, the wash water supply determination part 47 determines that the wash water W cannot be supplied to the bowl 11. The wash water supply determination part 47 determines that the wash water W cannot be supplied to the bowl 11 from the closing of the wash water supply unit 30 until the completion of the determination of the clogging state of the toilet 10. In other words, the wash water supply determination part 47 prohibits the opening operation of the wash water supply unit 30 from the closing of the wash water supply unit 30 until the completion of the determination of the clogging state of the toilet 10.

The supply controller 45 transmits, to the opening/closing controller 49, a command signal indicating the determination of the wash water supply determination part 47 that the wash water W cannot be supplied. In a case where the opening/closing controller 49 receives the command signal that the wash water W cannot be supplied, the opening/closing controller 49 prohibits the opening operation of the wash water supply unit 30 even when a toilet washing command signal from the user is received.

The malfunction determination part 48 of the supply controller 45 determines that the wash water supply unit 30 malfunctions in a case where the sensing unit 41 senses the wash water W a predetermined time after the wash water supply unit 30 is closed. The malfunction determination part 48 implements the malfunction determination except when the toilet 10 is in the process of washing and when the clogging of the toilet 10 is determined. In other words, the malfunction determination regarding the wash water supply unit 30 is implemented while the toilet 10 stands by without being used.

The malfunction of the wash water supply unit 30 is a state where the wash water W is continuously supplied from the water supply pipe line 21 to the bowl 11 due to, for example, a poor water stop of the wash water supply unit 30 or an incompletely closed state. Examples of the malfunction of the wash water supply unit 30 include a failure of the wash water supply unit 30 itself and a poor water stop attributable to dust biting in a seal portion (not shown) of the wash water supply unit 30. The malfunction determination regarding the wash water supply unit 30 made by the malfunction determination part 48 will be described later.

Next, a state at a time when the wash water W is poured into the bowl 11 of the toilet 10 will be described.

As shown in FIG. 2A, when the wash water supply unit 30 has been switched to the open state, the wash water W is discharged from the first water discharge port 24*a* and the second water discharge port 25*a* of the flow channel 20 toward the surface 12 of the bowl 11. As a result, the wash water W spreads over the entire surface 12 of the bowl 11 and is capable of washing the surface 12 of the bowl 11.

Next, when the wash water supply unit 30 has been switched from the open state to the closed state, the wash water W remaining in the flow channel 20 on the downstream side of the wash water supply unit 30 is discharged to the bowl 11. As shown in FIG. 2B, in this case, the amount and flow velocity of the wash water W discharged from the first water discharge port 24*a* and the second water discharge port 25*a* decrease on the surface 12 of the bowl 11, and thus the wash water W flows to the bottom portion 11*a* of the bowl 11 with a small swirling amount.

Subsequently, as shown in FIGS. 3A and 3B, the amount and flow velocity of the wash water W gradually decrease and the wash water W flows vertically from the first water discharge port 24*a* and the second water discharge port 25*a* toward the bottom portion 11*a* of the bowl 11. In other words, the wash water W drips from the first water discharge port 24*a* and the second water discharge port 25*a* toward the bottom portion 11*a* of the bowl 11. In a case where the water discharge of the wash water W from the first water discharge port 24*a* and the second water discharge port 25*a* is completed, the wash water W collects in the bottom portion 11*a* of the bowl 11.

As shown in FIG. 1, in a normal state where the toilet 10 is not clogged, the sealing water level S2 is the position of the water surface of the water (sealing water) in the toilet 10. When the toilet 10 is clogged with foreign matter (not shown), the wash water W does not flow, and thus the position of the water surface in the toilet 10 is a limit water level S3 higher than the sealing water level S2 and lower than the full water level S1. Accordingly, even when the toilet 10 is clogged with foreign matter, the wash water W does not overflow from the bowl 11 when the wash water W is supplied once. In other words, the limit water level S3 is positioned between the sealing water level S2 and the full water level S1 and is the position of the surface of the wash water W collecting in the bowl 11 when the toilet 10 is clogged.

In this case, the limit water level S3 is the position that becomes the full water level S1 when the wash water W for rinsing fecal away is supplied by a single amount. In other words, the limit water level S3 is the position at which the single amount of wash water W for rinsing fecal away is subtracted from the full water level S1. In other words, when the wash water W for rinsing fecal away is supplied by the single amount with the wash water W at the limit water level S3, the wash water W collects up to the full water level S1. The sensing unit 41 senses the wash water W positioned between the sealing water level S2 and the limit water level S3.

As shown in FIG. 4, the wash water W gradually collects in the first branch passageway 24 and the second branch passageway 25 in a case where malfunction such as a poor water stop has occurred in the wash water supply unit 30. As shown in FIG. 3B, the wash water W finally flows vertically from the first water discharge port 24*a* and the second water discharge port 25*a* toward the bottom portion 11*a* of the bowl 11. In a case where the wash water supply unit 30 malfunctions, for example, the state of FIG. 3B and the state of FIG. 4 are repeated. In other words, in a case where the wash water supply unit 30 malfunctions, the wash water W drips intermittently or continuously in the vertical direction from the first water discharge port 24*a* and the second water discharge port 25*a* toward the bottom portion 11*a* of the bowl 11.

Next, the sensing region 42 on the surface 12 of the bowl 11 sensed by the sensing unit 41 will be described. As shown in FIGS. 2 to 4, the sensing region 42 is set between the first water discharge port 24*a* and the bottom portion 11*a* of the bowl 11 on the surface 12 of the bowl 11.

Specifically, as shown in FIG. 3B, the sensing region 42 of the sensing unit 41 is the position on the surface 12 of the bowl 11 through which the wash water W flowing vertically from the first water discharge port 24*a* to the bottom portion 11*a* of the bowl 11 passes after the wash water supply unit 30 is closed. In this case, the wash water W flowing out of the first water discharge port 24*a* flows down with, for example, a width A of 1 cm or more and 6 cm or less (1 cm≤A≤6 cm).

A width B of the sensing region 42 is more than the width A of the wash water W flowing in the vertical direction. In other words, the sensing region 42 includes a position where the wash water W flowing vertically from the first water discharge port 24*a* of the flow channel 20 toward the bottom portion 11*a* of the bowl 11 after the wash water supply unit 30 is closed does not pass.

The width B of the sensing region 42 is, for example, 14 mm or more along the surface 12 of the bowl 11. The width B of the sensing region 42 is favorably 24 mm or more. The width B of the sensing region 42 is set by experiment or simulation in view of the width A and position of the wash water W flowing in the vertical direction based on the shape of the toilet 10, the position and size of the first water discharge port 24*a*, and so on.

As a result, the wash water W flows to a part of the sensing region 42 in a case where the wash water supply unit 30 malfunctions. Accordingly, the difference in amount of the wash water W flowing through the sensing region 42 differs greatly between a case where the wash water supply unit 30 malfunctions and a case where the toilet 10 is clogged. As a result, the supply controller 45 is capable of accurately determining the clogging state of the toilet 10 and malfunction of the wash water supply unit 30.

Favorably, the sensing region 42 of the sensing unit 41 is below the water discharge port positioned behind a longitudinal center O1-O1 of the bowl 11. As shown in FIG. 1, the center O1-O1 in this case can be the center of a longitudinal length L of the opening 13 of the bowl 11.

The rear side 12*a* of the bowl 11 is erected more vertically than the front side 12*b*, and thus the rear side 12*a* is a position where waste adhesion is unlikely to occur. The surface 12 of the bowl 11 that is below the water discharge port (first water discharge port 24*a*) is a position where the wash water W flows to the end and thus is less prone to waste adhesion.

In the embodiment, the sensing region 42 is provided below the first water discharge port 24*a*. As shown in FIG. 5, the sensing region 42 is provided at a position where a slope angle θ of the surface 12 of the bowl 11 is less than 45 degrees with respect to the vertical direction. The sensing region 42 may include a position where the slope angle θ is less than 45 degrees. In other words, the sensing region 42 may partially include a position where the angle θ formed by a vertical line C-C and a tangent line D-D of the surface 12 of the bowl 11 is less than 45 degrees. In FIG. 5, the slope angle θ of the surface 12 of the bowl 11 through which a center P1 as the maximum directivity direction of the radio wave P emitted from the sensing unit 41 passes is less than 45 degrees.

As a result, the sensing unit 41 is capable of suppressing sensing the waste that has adhered to the surface 12 of the bowl 11 (such as excrement containing moisture). Accordingly, the toilet device 40 is capable of effectively sensing the clogging state of the toilet 10 and improving the usability of the toilet 10.

In a case where the wash water supply unit 30 malfunctions, the flow velocity of the wash water W flowing vertically from the first water discharge port 24*a* toward the bottom portion 11*a* of the bowl 11 can be increased. In a case where the toilet 10 is clogged, the wash water W collects in the bowl 11, and thus the flow velocity of the wash water W flowing in the sensing region 42 decreases.

As a result, the sensing unit 41 is capable of sensing the large flow velocity difference between the flow velocity of the wash water W flowing on the surface 12 of the bowl 11 in a case where the toilet 10 is clogged and the flow velocity of the wash water W flowing on the surface of the bowl 11 in a case where the wash water supply unit 30 malfunctions. Accordingly, the supply controller 45 is capable of accurately determining the clogging state of the toilet 10 and malfunction of the wash water supply unit 30.

Next, the orientation of the vertical direction of the radio wave P emitted by the sensing unit 41 will be described.

As shown in FIG. 5, the sensing unit 41 forms the sensing region 42 on the rear side 12*a* of the bowl 11 by emitting the radio wave P diagonally upward. In this case, the center P1 of the sensing region 42 of the sensing unit 41 is positioned above a center position S4 between the sealing water level S2 and the limit water level S3.

Specifically, the center P1 of the sensing region 42 of the sensing unit 41 is positioned between the center position S4 and the limit water level S3 on the rear side 12*a* of the surface 12 of the bowl 11. The center P1 is the maximum directivity direction in which the intensity of the radio wave P is maximized in the sensing region 42 of the sensing unit 41. For example, the sensing unit 41 is disposed in the toilet 10 such that a radiating unit emitting the radio wave P is positioned above the center position S4. As a result, the sensing unit 41 is capable of positioning the center P1 of the radio wave P on the surface 12 of the bowl 11 above the center position S4.

The surface 12 of the bowl 11 may be hydrophilic. Then, the wash water W may gradually wetly spread as the wash water W flows down the surface 12 of the bowl 11 toward the bottom portion 11*a*. Accordingly, as for the sensing unit 41, the impact of the wash water W that wetly spreads can be reduced by the center P1 of the sensing region 42 being at a high position (on the limit water level S3 side) where the wash water W is yet to wetly spread. Accordingly, the sensing unit 41 is capable of suppressing erroneous sensing attributable to the wash water W that has wetly spread.

Next, a change in the state of sensing by the sensing unit 41 will be described with the passage of time.

Figure 6A:
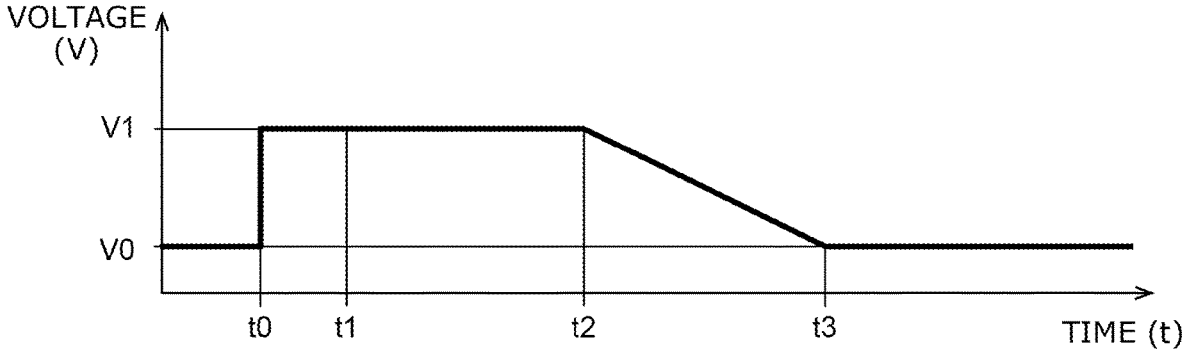
FIGS. 6A to 6C are characteristic diagrams of a case where the sensing unit is a radio wave sensor.
Figure 6B:
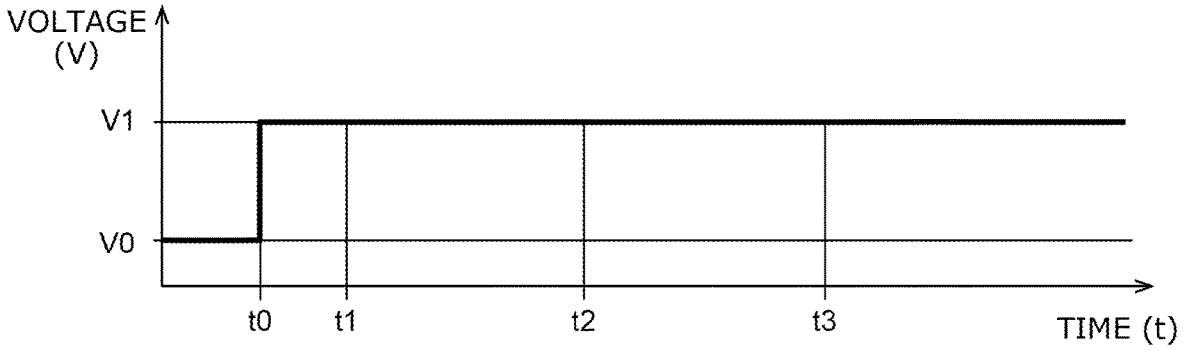
Figure 6C:
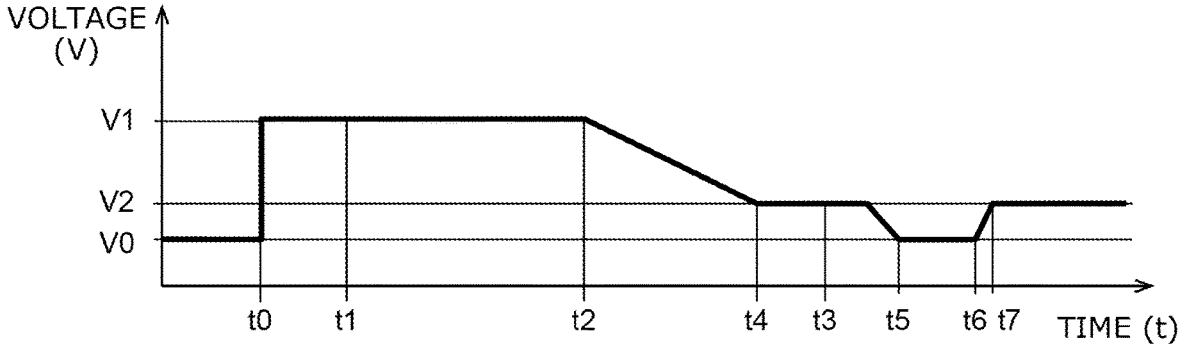

FIGS. 6A to 6C are characteristic diagrams of a case where the sensing unit is a radio wave sensor.

FIG. 6A is a characteristic diagram at a time when the toilet is not clogged.

FIG. 6B is a characteristic diagram at a time when the toilet is clogged.

FIG. 6C is a characteristic diagram at a time when the wash water supply unit malfunctions.

A case where the toilet 10 is not clogged and is in a normal state will be described with reference to FIG. 6A.

As shown in FIG. 6A, at time t0, the wash water supply unit 30 is switched from the closed state to the open state by the user performing the toilet washing operation. As a result, the wash water W flows from the first water discharge port 24*a* and the second water discharge port 25*a* to the surface 12 of the bowl 11 (see FIG. 2A). In this case, the sensing unit 41 senses the wash water W in the entire sensing region 42. As a result, the voltage value of the sensing unit 41 changes from a voltage V0 to a voltage V1.

Next, at time t1, the wash water supply unit 30 is switched from the open state to the closed state. As a result, the wash water supply unit 30 ends the supply of the wash water W to the bowl 11. The supply controller 45 prohibits the opening operation of the wash water supply unit 30 from time t1 when the wash water supply unit 30 is closed until the determination of the clogging state of the toilet 10 is completed. From time t1 to time t2, the wash water W in the flow channel 20 on the downstream side of the wash water supply unit 30 flows over the entire sensing region 42 of the bowl 11 (FIGS. 2B and 3A). Accordingly, the voltage value of the sensing unit 41 is maintained at the voltage V1 by the wash water W.

From time t2 to time t3, the amount of the wash water W discharged from the first water discharge port 24*a* decreases. As a result, the wash water W flows to a part of the sensing region 42. In this case, the amount of the wash water W flowing in the sensing region 42 gradually decreases as shown in FIGS. 3A and 3B. As a result, the voltage value of the sensing unit 41 changes from the voltage V1 toward the voltage V0. At time t3, the voltage value of the sensing unit 41 becomes the voltage V0 with the discharging from the first water discharge port 24*a* and the second water discharge port 25*a* completed.

At time t3, the clogging determination part 46 of the supply controller 45 calculates whether or not the difference between a voltage Va detected after the toilet 10 is washed and a voltage Vb as the maximum value detected during the washing of the toilet 10 is equal to or greater than a threshold value Vx. As a result, the clogging determination part 46 determines whether or not the toilet 10 is clogged ($|Va-Vb| \geq Vx$). The threshold value Vx is a value for determining the clogging of the toilet 10. The threshold value Vx is pre-stored in the storage unit (not shown) of the supply controller 45. In a case where the toilet 10 is not clogged, the absolute value of the difference between the voltage Va at time t3 (=V0) and the voltage Vb from time t1 to t2 (=V1) is equal to or greater than the threshold value Vx ($|V0-V1| \geq Vx$).

Next, a case where the toilet 10 is clogged will be described with reference to FIG. 6B.

In a case where the toilet 10 is clogged, the water surface of the wash water W rises to the limit water level S3 of the bowl 11 (see FIGS. 2A and 5). Accordingly, as shown in FIG. 6B, the voltage V does not change between time t2 and time t3. The voltage value of the sensing unit 41 continues to maintain the voltage (Va=Vb=V1). As a result, the clogging determination part 46 of the supply controller 45 is capable of determining that the toilet 10 is clogged.

The state shown in FIG. 6B is a state where the toilet 10 is completely clogged as there is no change in the voltage Vb during the washing of the toilet 10 and the voltage Va following the washing. The clogging determination part 46 of the supply controller 45 is capable of determining that the toilet 10 is half-clogged by, for example, setting the threshold value Vx based on the amount of the wash water W covering the sensing region 42.

Next, a case where the wash water supply unit 30 malfunctions will be described with reference to FIG. 6C.

In a case where malfunction such as a poor water stop has occurred in the wash water supply unit 30, the wash water W continues to be supplied from the wash water supply unit 30 to the wash water passageway 22 even after time t2 when the wash water supply unit 30 is closed. Then, the wash water W gradually decreases after the wash water W continues to drip vertically from the first water discharge port 24*a* toward the bottom portion 11*a* of the bowl 11 from, for example, time t4 preceding time t3 to time t5 following time t3 (see FIG. 3B).

Between time t5 and time t6, the wash water W leaking from the wash water supply unit 30 to the wash water passageway 22 collects in the first branch passageway 24 (see FIG. 4). From time t6 to time t7, the wash water W that has collected in the first branch passageway 24 drips vertically from the first water discharge port 24*a* toward the bottom portion 11*a* of the bowl 11 (see FIG. 3B).

In this manner, in a case where the wash water supply unit 30 malfunctions, the voltage V changes intermittently after time t3 when the clogging of the toilet 10 is determined. The malfunction determination part 48 of the supply controller 45 determines that the wash water supply unit 30 malfunctions by detecting the change in the voltage V.

Specifically, the clogging determination part 46 of the supply controller 45 determines that the toilet 10 is not clogged by calculating that the absolute value of the difference between the voltage Va at time t3 (=V2) and the voltage Vb from time t1 to time t2 (=V1) is equal to or greater than the threshold value Vx ($|V2-V1| \geq Vx$).

The malfunction determination part 48 of the supply controller 45 calculates that the absolute value of the difference between a voltage Vc at subsequent time t7 (=V2) and the voltage V0 from time t5 to time t6 is equal to or greater than a threshold value Vy ($|V2-V0| \geq Vy$). As a result, the malfunction determination part 48 determines that the wash water supply unit 30 malfunctions. The threshold value Vy is set to a value for determining whether or not malfunction such as a poor water stop has occurred in the wash water supply unit 30. The threshold value Vy is pre-stored in the storage unit (not shown) of the supply controller 45. The threshold value Vy is smaller than the threshold value Vx at a time when the clogging of the toilet 10 is determined.

Thus, as for the toilet device 40 according to the embodiment, the sensing region 42 of the sensing unit 41 is provided at the position on the surface 12 of the bowl 11 through which the wash water W flowing vertically from the water discharge port (first water discharge port 24*a*) of the flow channel (first branch passageway 24) toward the bottom portion 11*a* of the bowl 11 passes after the wash water supply unit 30 is closed.

In other words, the sensing region 42 is provided at the position on the surface 12 of the bowl 11 where dirt is unlikely to adhere or dirt that has adhered is easily removed by the wash water W. Accordingly, the toilet device 40 is capable of accurately determining the clogging of the toilet 10. By the sensing region 42 being provided at such a position, the toilet device 40 is capable of monitoring malfunction such as a poor water stop of the wash water supply unit 30 by means of the sensing unit 41 and without a new sensing unit while, for example, the toilet 10 stands by without being used.

Figure 7A:
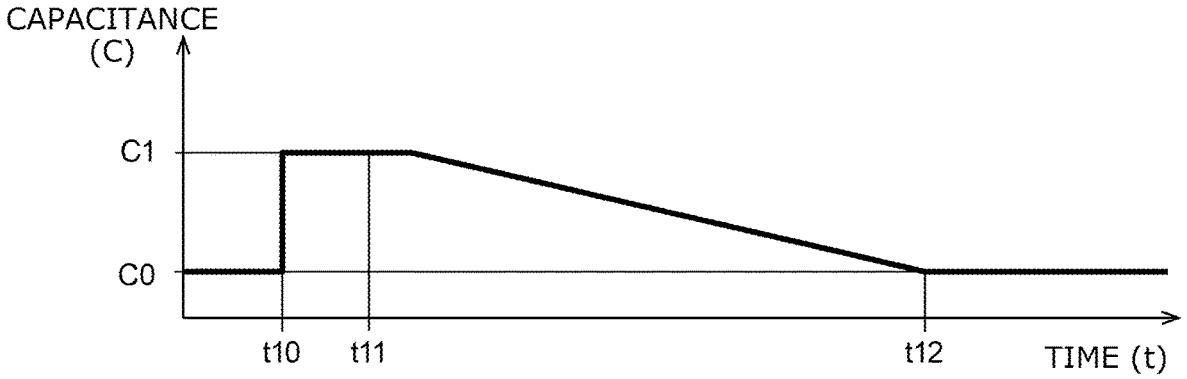
FIGS. 7A to 7C are characteristic diagrams of a case where the sensing unit provided in the toilet device according to a first variation of the invention is a capacitance sensor.
Figure 7B:
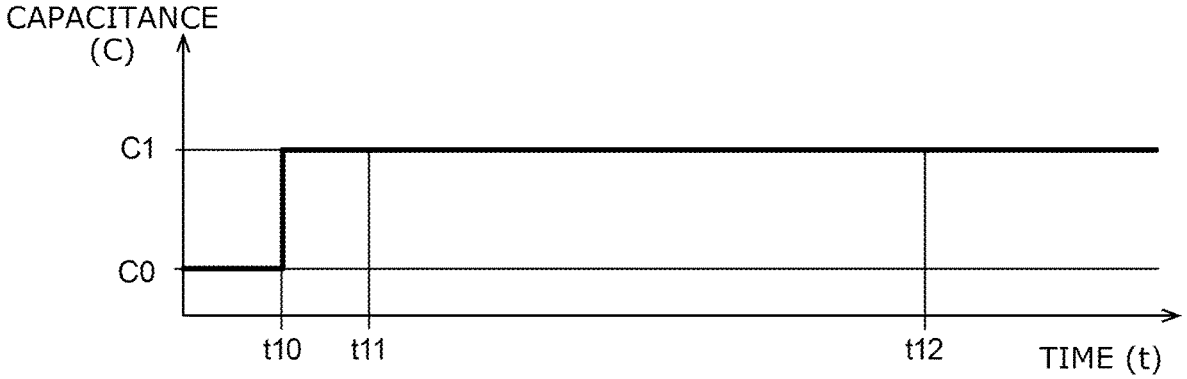
Figure 7C:
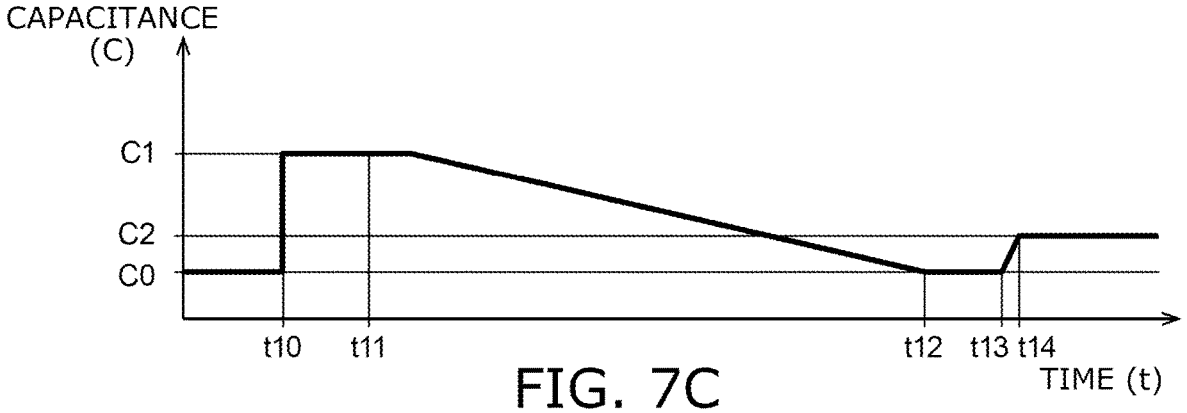

FIGS. 7A to 7C are characteristic diagrams of a case where the sensing unit provided in the toilet device according to a first variation of the invention is a capacitance sensor.

FIG. 7A is a characteristic diagram at a time when the toilet is not clogged.

FIG. 7B is a characteristic diagram at a time when the toilet is clogged.

FIG. 7C is a characteristic diagram at a time when the wash water supply unit malfunctions.

A case where the toilet 10 is not clogged and is in a normal state will be described with reference to FIG. 7A.

As shown in FIG. 7A, at time t10, the wash water supply unit 30 is switched from the closed state to the open state by the user performing the toilet washing operation. As a result, the wash water W flows from the first water discharge port 24*a* and the second water discharge port 25*a* to the surface 12 of the bowl 11. In this case, the sensing unit 41 senses a capacitance C1 from a capacitance C0.

Next, at time t11, the wash water supply unit 30 is switched from the open state to the closed state. As a result, the wash water supply unit 30 ends the supply of the wash water W to the bowl 11. The supply controller 45 prohibits the opening operation of the wash water supply unit 30 from time t11 when the wash water supply unit 30 is closed until the determination of the clogging state of the toilet 10 is completed. From time t11 to time t12, a gradual decrease from the capacitance C1 to the capacitance C0 occurs as the volume of the wash water W around the electrode (sensing region 42) decreases.

At time t12, the clogging determination part 46 of the supply controller 45 calculates the difference between a capacitance Ca detected after the toilet 10 is washed and a capacitance Cb as the maximum value detected during the washing of the toilet 10. The clogging determination part 46 calculates that the difference between the capacitance Ca and the capacitance Cb is sufficient (equal to or greater than a threshold value Cx). As a result, the clogging determination part 46 is capable of determining whether or not the toilet 10 is clogged ($|Ca-Cb| \geq Cx$). The threshold value Cx is a value for determining the clogging of the toilet 10. The threshold value Cx is pre-stored in the storage unit (not shown) of the supply controller 45. In a case where the toilet 10 is not clogged, the absolute value of the difference between the capacitance Ca at time t12 (=C0) and the capacitance Cb at time t11 (=C1) is equal to or greater than the threshold value Cx ($|C0-C1| \geq Cx$).

Next, a case where the toilet 10 is clogged will be described with reference to FIG. 7B.

In a case where the toilet 10 is clogged, the water surface of the wash water W rises to the limit water level S3 of the bowl 11 (see FIGS. 2A and 5). Accordingly, as shown in FIG. 7B, the capacitance C does not change between time t11 and time t12. The capacitance value of the sensing unit 41 continues to maintain the capacitance (Ca=Cb=C1). As a result, the clogging determination part 46 of the supply controller 45 is capable of determining that the toilet 10 is clogged.

The state shown in FIG. 7B is a state where the toilet 10 is completely clogged as there is no change in the capacitance Cb during the washing of the toilet 10 and the capacitance Ca following the washing. The clogging determination part 46 of the supply controller 45 is capable of determining that the toilet 10 is half-clogged by, for example, setting the threshold value Cx based on the amount of the wash water W covering the sensing region 42.

Next, a case where the wash water supply unit 30 malfunctions will be described with reference to FIG. 7C.

In a case where malfunction such as a poor water stop has occurred in the wash water supply unit 30, the wash water W leaking from the wash water supply unit 30 to the wash water passageway 22 collects in the first branch passageway 24 between time t12 and time t13 (see FIG. 4). From time t13 to time t14, the wash water W that has collected in the first branch passageway 24 drips vertically from the first water discharge port 24*a* toward the bottom portion 11*a* of the bowl 11 (see FIG. 3B).

In this manner, in a case where the wash water supply unit 30 malfunctions, the capacitance C changes intermittently after time t12 when the clogging of the toilet 10 is determined. The malfunction determination part 48 of the supply controller 45 determines that the wash water supply unit 30 malfunctions by detecting the change in the capacitance C.

Specifically, the clogging determination part 46 of the supply controller 45 determines that the toilet 10 is not clogged by calculating that the absolute value of the difference between the capacitance Ca at time t12 (=C0) and the capacitance Cb at time t11 (=C1) is equal to or greater than the threshold value Cx ($|C0-C1| \geq Cx$).

The malfunction determination part 48 of the supply controller 45 calculates that the absolute value of the difference between a capacitance Cc at subsequent time t14 (=C2) and the capacitance C0 from time t12 to time t13 is equal to or greater than a threshold value Cy ($|C2-C0| \geq Cy$). As a result, the malfunction determination part 48 determines whether or not the wash water supply unit 30 malfunctions. The threshold value Cy is set to a value for determining whether or not malfunction such as a poor water stop has occurred in the wash water supply unit 30. The threshold value Cy is pre-stored in the storage unit (not shown) of the supply controller 45. The threshold value Cy is smaller than the threshold value Cx at a time when the clogging of the toilet 10 is determined.

In this manner, the supply controller 45 is capable of determining the clogging state of the toilet 10 and malfunction of the wash water supply unit 30 using the time-dependent change in the capacitance C sensed by the sensing unit 41 that is a capacitance sensor.

Figure 8:
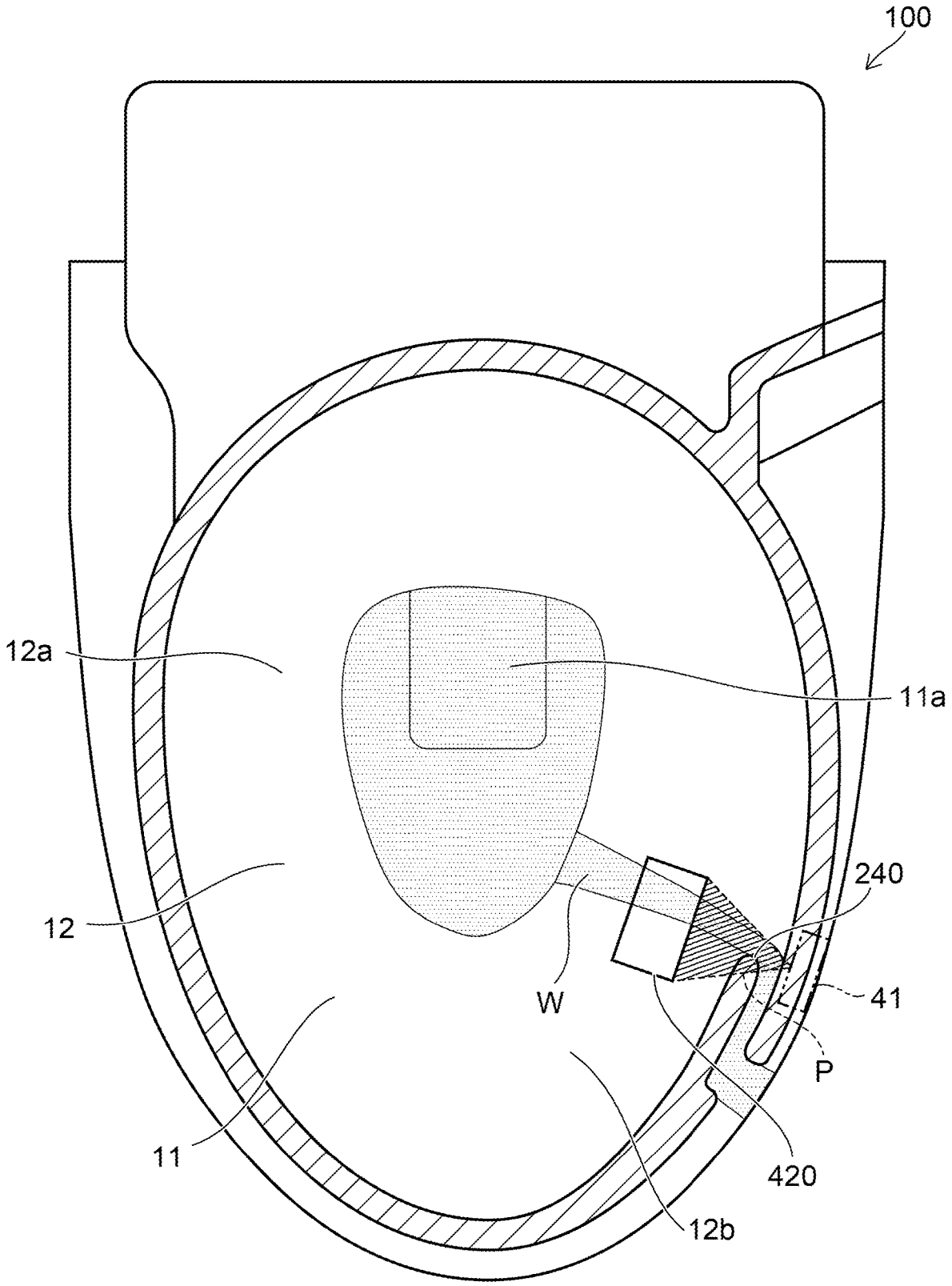
FIG. 8 is a cross-sectional view similar to FIG. 3B and showing the toilet device according to a second variation of the invention.

FIG. 8 is a cross-sectional view similar to FIG. 3B and showing the toilet device according to a second variation of the invention.

In the embodiment, the toilet 10 having the two water discharge ports of the first water discharge port 24*a* and the second water discharge port 25*a* has been described as an example. However, the invention is not limited thereto. For example, a toilet 100 may have one water discharge port 240 as in the second variation shown in FIG. 8. In other words, a sensing region 420 may be provided at a position where the wash water W flowing vertically from the water discharge port 240 passes.

Figure 9:
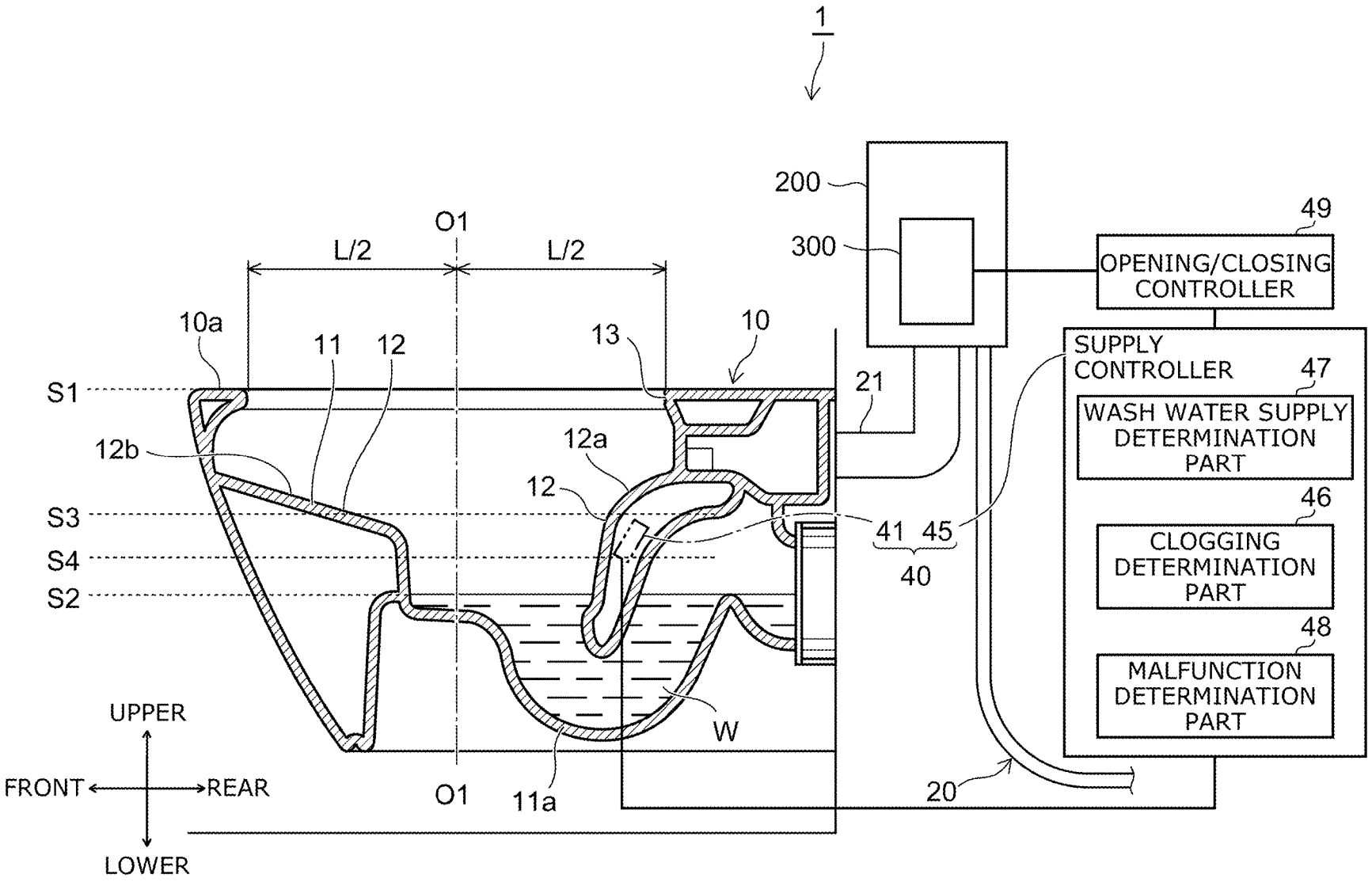
FIG. 9 is a schematic view showing the configuration of the tank-type toilet device according to a third variation of the invention.

FIG. 9 is a schematic view showing the configuration of the tank-type toilet device according to a third variation of the invention.

In the embodiment, a case where the wash water supply unit 30 is a flush valve provided on the water supply pipe line 21 has been described as an example. However, the invention is not limited thereto. For example, a wash water supply unit 300 may have a flapper valve provided inside a tank 200 as in the third variation shown in FIG. 9.

In the embodiment, a case where the sensing region 42 is provided below the first water discharge port 24*a* has been described as an example. However, the invention is not limited thereto. For example, the sensing region may be provided below the second water discharge port 25*a*.

In the embodiment, a case where it is determined that the wash water supply unit 30 malfunctions when the wash water W is sensed once after the clogging of the toilet 10 is determined has been described as an example. However, the invention is not limited thereto. For example, it may be determined that the wash water supply unit 30 malfunctions when the wash water W is sensed a plurality of times.

In the embodiment, a case where the sensing unit 41 senses the amount of the wash water W in the bowl 11 has been described as an example. However, the invention is not limited thereto. For example, the supply controller 45 may determine the clogging of the toilet 10 or malfunction of the wash water supply unit 30 using the flow velocity of the wash water W flowing in the bowl 11 that is detected by the sensing unit 41. In a case where the toilet 10 is clogged, the wash water W collects in the bowl 11, and thus the flow velocity of the wash water W decreases. In a case where the wash water supply unit 30 malfunctions, the wash water W flows from the first water discharge port 24*a* toward the bottom portion 11*a* of the bowl 11, and thus the flow velocity increases.

In the embodiment, a case where the malfunction determination regarding the wash water supply unit 30 is made after the clogging determination regarding the toilet 10 has been described as an example. However, the invention is not limited thereto. For example, only the clogging determination regarding the toilet 10 may be made. In other words, the malfunction determination regarding the wash water supply unit 30 may be made as needed.

The following aspects or the like are conceivable as the toilet device based on the embodiment described above.

A first aspect includes: a toilet having a bowl; a flow channel having a water discharge port configured to discharge wash water to the bowl; a wash water supply unit provided on the flow channel and configured to open or close to control a flow of the wash water; a sensing unit configured to sense whether or not the wash water is at a position lower than a full water level and higher than a sealing water level on a surface of the bowl; and a controller configured to determine a clogging state of the toilet based on a sensing result of the sensing unit following the closing of the wash water supply unit, in which a sensing region of the sensing unit is a position on the surface of the bowl through which the wash water flowing in a vertical direction from the water discharge port to a bottom portion of the bowl passes after the wash water supply unit is closed.

According to the first aspect, the sensing region is provided at the position on the surface of the bowl where dirt is unlikely to adhere or dirt that has adhered is easily removed by the wash water. Accordingly, the clogging of the toilet can be accurately determined. By the sensing region being provided at such a position, it is possible to monitor malfunction such as a poor water stop of the wash water supply unit by means of the sensing unit and without a new sensing unit while, for example, the toilet stands by without being used.

In a second aspect according to the first aspect, the sensing unit is configured to output different sensing results to the controller depending on an amount or a flow velocity of the wash water flowing on the surface of the bowl.

In a case where the toilet is clogged, a large amount of wash water collects in the toilet, and thus the amount of the wash water in the sensing region is large and the flow velocity is low. In a case where the wash water supply unit malfunctions, a small amount of wash water flows vertically from the water discharge port, and thus the amount of the wash water in the sensing region is small. In such a case, the flow velocity is higher than that in the state where a large amount of wash water has collected in the toilet. According to the second aspect, the controller is capable of determining the degree of clogging of the toilet. It is possible to accurately determine the clogging of the toilet and malfunction of the wash water supply unit.

In a third aspect according to the first or second aspect, the controller is configured to determine the clogging state of the toilet and a malfunction of the wash water supply unit based on a time-dependent change in the sensing result outputted from the sensing unit.

According to the third aspect, in a case where the toilet is clogged, a large amount of wash water collects in the toilet, and thus the sensing result is a constant or small change. In a case where the wash water supply unit 30 malfunctions, a small amount of wash water flows intermittently from the water discharge port, and thus the sensing result fluctuates. Accordingly, the controller is capable of accurately determining the state of clogging of the toilet and the malfunction state of the wash water supply unit.

In a fourth aspect according to any one of the first to third aspects, a width of the sensing region of the sensing unit is more than a width of the wash water flowing in the vertical direction.

In a fifth aspect according to the fourth aspect, the width of the sensing region is 14 mm or more along the surface of the bowl.

According to the fourth and fifth aspects, the difference in amount of the wash water in the sensing region can be further increased between when the toilet is clogged and when the wash water supply unit malfunctions. Accordingly, it is possible to more accurately determine the clogging of the toilet and malfunction of the wash water supply unit.

In a sixth aspect according to any one of the first to fifth aspects, the sensing region of the sensing unit is provided at a position where a slope angle of the surface of the bowl is less than 45 degrees with respect to the vertical direction.

According to the sixth aspect, the sensing region is the steep slope on the surface of the bowl where dirt is unlikely to adhere, and thus erroneous sensing of dirt such as excrement can be suppressed. The difference in flow velocity of the wash water in the sensing region can be further increased between when the toilet is clogged and when the wash water supply unit malfunctions. Accordingly, it is possible to more accurately determine the clogging of the toilet and malfunction of the wash water supply unit.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. For example, the shape, the dimension, the material, the disposition, the installation feature or the like of the components included in the toilet device 40 are not limited to the illustration and can be appropriately modified. The components included in the embodiments described above can be combined within the extent of technical feasibility, and any combined components also are included in the scope of the invention to the extent that the feature of the invention is included.

What is claimed is:

1. A toilet device comprising:

a toilet having a bowl;

a flow channel having a water discharge port configured to discharge wash water to the bowl;

a wash water supply unit provided on the flow channel and configured to open or close to control a flow of the wash water;

a sensing unit configured to sense whether or not the wash water is at a position lower than a full water level and higher than a sealing water level on a surface of the bowl; and a controller configured to determine a clogging state of the toilet based on a sensing result of the sensing unit following the closing of the wash water supply unit, wherein a sensing region of the sensing unit is a position on the surface of the bowl through which the wash water flowing in a vertical direction from the water discharge port to a bottom portion of the bowl passes after the wash water supply unit is closed, and the sensing region of the sensing unit includes at least a portion of an area connecting the water discharge port and the bottom portion of the bowl when viewed in a plan view.

2. The device according to claim 1, wherein the sensing unit is configured to output different sensing results to the controller depending on an amount or a flow velocity of the wash water flowing on the surface of the bowl.

3. The device according to claim 1, wherein the controller is configured to determine the clogging state of the toilet and a malfunction of the wash water supply unit based on a time-dependent change in the sensing result outputted from the sensing unit.

4. The device according to claim 1, wherein a width of the sensing region of the sensing unit is more than a width of the wash water flowing in the vertical direction.

5. The device according to claim 4, wherein the width of the sensing region is 14 mm or more along the surface of the bowl.

6. The device according to claim 1, wherein the sensing region of the sensing unit is provided at a position where a slope angle of the surface of the bowl is less than 45 degrees with respect to the vertical direction.

* * * * *